US011045368B2

(12) United States Patent
Pagano et al.

(10) Patent No.: US 11,045,368 B2
(45) Date of Patent: Jun. 29, 2021

(54) WHEELCHAIR DEVICE FOR ACTIVELY MOVING A SEAT UNIT OF A WHEELCHAIR

(71) Applicant: DESINO GmbH, Cologne (DE)

(72) Inventors: Roman Pagano, Cologne (DE); Thyl Junker, Cologne (DE); Daniel Levedag, Cologne (DE)

(73) Assignee: DESINO GmbH, Cologne (DE)

( * ) Notice: Subject to any disclaimer, the term of this patent is extended or adjusted under 35 U.S.C. 154(b) by 0 days.

(21) Appl. No.: 16/604,233

(22) PCT Filed: Apr. 4, 2018

(86) PCT No.: PCT/EP2018/058559
§ 371 (c)(1),
(2) Date: Oct. 10, 2019

(87) PCT Pub. No.: WO2018/189003
PCT Pub. Date: Oct. 18, 2018

(65) Prior Publication Data

US 2020/0163816 A1 May 28, 2020

(30) Foreign Application Priority Data

Apr. 12, 2017 (DE) ..... 10 2017 107 964.5

(51) Int. Cl.
*A61G 5/10* (2006.01)
*A61G 5/02* (2006.01)

(52) U.S. Cl.
CPC ..... *A61G 5/1056* (2013.01); *A61G 5/1067* (2013.01); *A61G 5/025* (2013.01); *A61G 5/1081* (2016.11)

(58) Field of Classification Search
CPC .... A61G 5/1056; A61G 5/1067; A61G 5/105; A61G 5/1075; A61G 5/1072; A61G 5/1064; A61G 5/1062; A61G 5/1059
See application file for complete search history.

(56) References Cited

U.S. PATENT DOCUMENTS 6,168,178 B1 * 1/2001 Garven, Jr. ..... A61G 5/08 280/250.1
6,257,609 B1 * 7/2001 O'Neill, Sr. ..... A61G 5/107 280/250.1

(Continued)

FOREIGN PATENT DOCUMENTS

DE 10 2012 021 592 A1 5/2014
EP 2 727 568 A1 5/2014

(Continued)

OTHER PUBLICATIONS

Search Report dated Nov. 14, 2017 issued in corresponding DE patent application No. 10 2017 107 964.5 (and English translation).

(Continued)

*Primary Examiner* — Emma K Frick
(74) *Attorney, Agent, or Firm* — Posz Law Group, PLC

(57) ABSTRACT

A wheelchair device for actively moving a seat unit, in particular a seat part and/or a backrest part of the seat unit, of a wheelchair, has at least one movement conversion unit which is arrangeable at least in part on at least one drive wheel of the wheelchair and which is provided for the purpose of converting a movement of the at least one drive wheel into a movement of the seat unit.

9 Claims, 3 Drawing Sheets

(56) References Cited

U.S. PATENT DOCUMENTS

Figure 1:
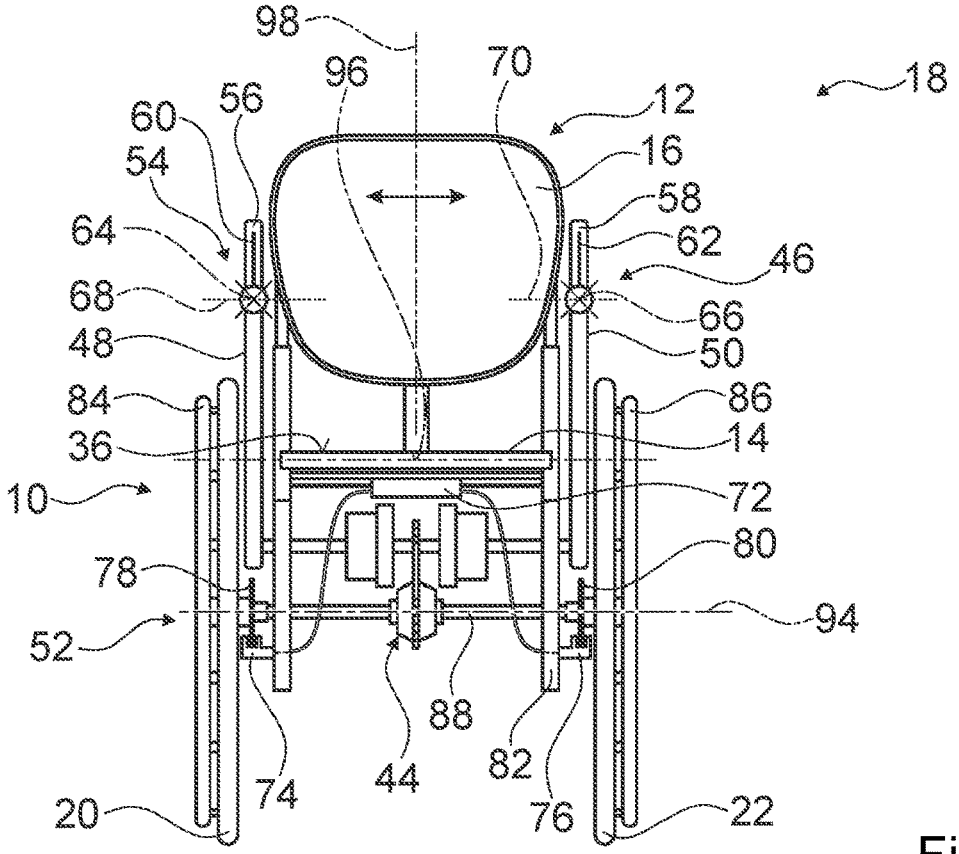

| | | | | |
|---|---|---|---|---|
| 6,447,064 | B1 * | 9/2002 | Mundy | A61G 5/00 297/313 |
| 6,655,503 | B1 * | 12/2003 | Moody | A61G 5/10 188/2 F |
| 6,902,177 | B2 * | 6/2005 | Lindsay | A61G 5/023 280/282 |
| 8,251,393 | B2 | 8/2012 | Fremgen et al. | |
| 8,844,959 | B2 * | 9/2014 | Winter, V | A61G 5/023 280/244 |
| 9,010,787 | B2 * | 4/2015 | Slagerman | A61G 5/128 280/250.1 |
| 9,931,254 | B2 * | 4/2018 | Halsall | B62K 11/007 |
| 10,314,751 | B2 * | 6/2019 | Frei | A61G 5/02 |
| 10,624,803 | B2 * | 4/2020 | Parker | A61G 5/1075 |
| 2010/0090436 | A1 | 4/2010 | Fremgen | |
| 2015/0150738 | A1 | 6/2015 | Isik | |

FOREIGN PATENT DOCUMENTS

| | | | |
|---|---|---|---|
| JP | 2016-106875 | A | 6/2016 |
| WO | 2014/000115 | A1 | 1/2014 |

OTHER PUBLICATIONS

International Preliminary Report on Patentability dated Mar. 25, 2019 issued in corresponding International Patent Application No. PCT/EP2018/058559 (English translation only).

International Search Report of the International Searching Authority dated Jul. 20, 2018 issued in corresponding International Patent Application No. PCT/EP2018/058559 (English translation only).

* cited by examiner

WHEELCHAIR DEVICE FOR ACTIVELY MOVING A SEAT UNIT OF A WHEELCHAIR

CROSS REFERENCE TO RELATED APPLICATION

This application is a U.S. national stage application of International Application No. PCT/EP2018/058559, filed on Apr. 4, 2018, and based on German Patent Application No. 10 2017 107 964.5 filed on Apr. 12, 2017, the contents of which are incorporated herein by reference.

PRIOR ART

The invention relates to a wheelchair device for actively moving a seat unit, in particular a seat part and/or a backrest part of the seat unit, of a wheelchair according to claim 1.

DE 10 2012 021 592 A1 has already proposed a wheelchair device for actively moving a seat unit, in particular a seat part and/or a backrest part of the seat unit, of a wheelchair which includes at least one movement conversion unit which is arrangeable at least in part on at least one drive wheel of the wheelchair and is provided for the purpose of converting a movement of the at least one drive wheel into a movement of the seat unit.

JP 2016 106875 A has already proposed a wheelchair device for actively moving a foot support, the wheelchair device including at least one movement conversion unit which is provided for the purpose of converting a movement of at least one drive wheel into a movement of the foot support.

Furthermore, from US 20107090436 A1 a wheelchair device for actively moving a footrest of a wheelchair is already known, wherein the wheelchair device comprises at least one movement conversion unit that is at least in part arrangeable on at least one drive wheel of the wheelchair and which is provided for the purpose of converting a movement of the at least one drive wheel into a movement of the footrest. The movement conversion unit is realized as a cam mechanism unit, wherein, at least for acting on the seat part, the movement conversion unit comprises at least one movably supported cam mechanism element which is arrangeable on the footrest and comprises at least one contact surface which acts together with at least one movement guide path of at least one further cam mechanism element of the movement conversion unit which is realized as a cam disc and is arrangeable on the at least one drive wheel.

Beyond this, wheel chair devices are also already known from WO 2014/000115 A1 and EP 2 272 568 A1.

The object of the invention consists, in particular, in providing a generic wheelchair device with improved characteristics with regard to a structurally simple design and/or a convenient retrofitting capacity. The object is achieved according to the invention by the features of claim 1, whilst advantageous designs and further development of the invention can be found in the subclaims.

Advantages of the Invention

The invention proceeds from a wheelchair device for actively moving a seat unit, in particular a seat part and/or a backrest part of the seat unit, of a wheelchair, having at least one movement conversion unit which is arrangeable at least in part on at least one drive wheel of the wheelchair and which is provided for the purpose of converting a movement of the at least one drive wheel into a movement of the seat unit, wherein the movement conversion unit is realized as a cam mechanism unit, wherein, at least for acting on the seat part, the movement conversion unit comprises at least one movably supported cam mechanism element which is arrangeable on the seat part and comprises at least one contact surface which acts together with at least one movement guide path of at least one further cam mechanism element of the movement conversion unit, wherein the movement conversion unit comprises at least the further cam mechanism element, which is realized as a cam disc and is arrangeable on the at least one drive wheel.

It is proposed that the movement guide path of the further cam mechanism element is arranged on an inside surface of the further cam mechanism element facing a hub of the at least one drive wheel. A "cam mechanism unit" is to be understood, in particular, as a unit which is provided for the purpose of realizing, in dependence on sensing at least one rotatably supported or translationally supported cam mechanism element, a rotational drive or a translational drive of a rotatably or translationally supported further cam mechanism element. The term "provided" is to be understood, in particular, as especially designed and/or especially equipped. An element and/or a unit being provided for a certain function, is to be understood, in particular, as the element and/or the unit fulfilling and/or carrying out said certain function in at least one application and/or operating state. In a preferred manner, the movement conversion unit, in particular at least one cam mechanism element of the movement conversion unit, is arrangeable, in particular arranged, at least in part on a framework or on a frame of the wheelchair. The movement conversion unit, in particular at least one further cam mechanism element of the movement conversion unit, is preferably arrangeable, in particular arranged, at least in part on the at least one drive wheel of the wheelchair. The movement conversion unit is preferably provided for the purpose of converting a rotational movement of the at least one drive wheel into a movement of the seat unit about a movement axis of the seat unit which extends at least substantially perpendicularly to a rotational axis of the at least one drive wheel. The expression "substantially perpendicularly" is to define here, in particular, an alignment of a direction relative to a reference direction, the direction and the reference direction, when viewed, in particular, in a projection plane, enclosing an angle of 90° and the angle comprising a maximum deviation of, in particular, less than 8°, advantageously less than 5° and particularly advantageously less than 2°. The movement axis of the seat unit can extend at least substantially perpendicularly or at least substantially parallel to a sitting surface of the seat unit. The term "substantially parallel" is to be understood here, in particular, as an alignment of a direction relative to a reference direction, in particular in a plane, the direction comprising a deviation in relation to the reference direction of, in particular, less than 8°, advantageously less than 5° and particularly advantageously less than 2°. The movement conversion unit is provided in a preferred manner for the purpose of driving the seat unit in an oscillating manner about the movement axis, in particular in dependence on a rotational movement of the at least one drive wheel about the rotational axis of the drive wheel. The wheelchair device is preferably mountable on the wheelchair during the production of a wheelchair. However, it is also conceivable for the wheelchair device to be realized as a retrofit kit which is mountable on an already existing wheelchair, in particular in order to equip the already existing wheelchair after production with the wheelchair device according to the invention. A structurally simple design of the wheelchair device in order to drive the seat unit actively can be realized in an advantageous manner by means of the design according to the invention. It is advantageously possible in a structurally simple manner to utilize a rotational movement of the at least one drive wheel in order to realize an active movement of the seat unit. A convenient ability to retrofit a wheelchair, in particular with low expenditure, is advantageously possible with the wheelchair device according to the invention.

The cam mechanism element is preferably supportable, in particular supported, on the framework or on the frame of the wheelchair so as to be movable. In a preferred manner, the cam mechanism element is supportable, in particular supported, on the framework or on the frame of the wheelchair so as to be pivotable. In a preferred manner, a pivot axis of the cam mechanism element extends at least substantially parallel to the rotational axis of the at least one drive wheel. However, it is also conceivable for the cam mechanism element to be supportable, in particular supported, on the framework or on the frame of the wheelchair so as to be translationally movable. In the case of a translationally movable bearing arrangement of the cam mechanism element on the framework or on the frame of the wheelchair, it is conceivable for a linear movement axis of the cam mechanism element to extend at least substantially perpendicularly to the rotational axis of the at least one drive wheel. In a preferred manner, the cam mechanism element includes at least one seat contact surface, by means of which the cam mechanism element can abut, in particular abuts, against the seat unit, in particular against the seat part. The seat contact surface is preferably provided for the purpose of abutting against the seat part on a side of the seat part remote from a seat surface of the seat part. As an alternative to this or in addition to it, the cam mechanism element is fixable, in particular fixed, in particular, by means of a positive locking and/or non-positive locking connection, by way of at least one end on the seat unit, in particular on the seat part of the seat unit. The further cam mechanism element is arrangeable, in particular arranged, on the at least one drive wheel in a preferred manner so as to be non-rotatable. The further cam mechanism element is rotatable about the rotational axis of the drive wheel preferably together with the at least one drive wheel. In a preferred manner, the movement guide path forms an outer surface of the further cam mechanism element. The movement guide path of the further cam mechanism element is arranged in a preferred manner on an inside surface of the further cam mechanism element facing a hub of the at least one drive wheel. However, it is also conceivable for the movement guide path to be realized as a groove which is moved into the further cam mechanism element or is realized as a rib-shaped guide continuation which is supported on the further cam mechanism element, in particular is realized in one part with the further cam mechanism element. By means of the design according to the invention, it is advantageously possible in a structurally simple manner to utilize a rotational movement of the at least one drive wheel in order to realize an active movement of the seat unit. A convenient ability to retrofit a wheelchair, in particular with low expenditure, is advantageously possible with the wheelchair device according to the invention.

It is additionally proposed that the movement conversion unit comprises at least one cam mechanism element on which at least one friction-reducing element, in particular a rolling element, of the movement conversion unit is arranged which is provided to act together with a movement guide path of the movement conversion unit, in particular of at least one further cam mechanism element of the movement conversion unit. The friction-reducing element can form the contact surface of the cam mechanism element which acts together with the movement guide path of the further cam mechanism element. The friction-reducing element can be realized as a sliding surface element which is provided for the purpose of sliding along the movement guide path when the further cam mechanism element moves relative to the cam mechanism element, or the friction-reducing element can be realized as a movably supported rolling element, such as, for example, as a roll, as a roller, as an outside ring of a rolling bearing or the like, which is provided for the purpose of rolling along the movement guide path when the further cam mechanism element moves relative to the cam mechanism element. The friction-reducing element is preferably arranged at a further end of the cam mechanism element which is remote from the end of the cam mechanism element with which the cam mechanism element is fixable, in particular fixed, on the seat unit, in particular the seat part. By means of the design according to the invention, low-friction sensing of the movement guide path for actively moving the seat unit can be advantageously realized. It is advantageously possible in a structurally simple manner to utilize a rotational movement of the at least one drive wheel in order to realize an active movement of the seat unit.

It is additionally proposed that the movement conversion unit comprises at least one, in particular further, cam mechanism element which is arrangeable, in particular arranged, on the at least one drive wheel and comprises at least one movement guide path which comprises a non-circular, in particular oval or elliptical, progression. The term "non-circular" is to define, in particular, a geometric design which is different from an exact circle and is realized at least substantially free of edges or corners, as for example an ellipsoid, an oval or the like. The further cam mechanism element is preferably realized in a circular ring-shaped manner, an inside edge and/or inside surface of the further cam mechanism element, in particular delimiting and/or forming the movement guide path at least in part, comprising a non-circular, in particular oval or elliptical, progression. The inside edge and/or the inside surface of the further cam mechanism element is preferably arranged on the side of the further cam mechanism element facing the hub of the at least one drive wheel. The inside edge and/or the inside surface of the further cam mechanism element preferably delimits a recess which comprises a non-circular, in particular oval or elliptical, outside contour. The recess is preferably delimited by the movement guide path. The inside surface of the further cam mechanism element extends in a preferred manner at least substantially parallel to the rotational axis of the at least one drive wheel. By means of the design according to the invention, a curved track, which is usable for actuating the cam mechanism element for actively moving the seat unit, can be realized in a structurally simple manner. It is advantageously possible in a structurally simple manner to utilize a rotational movement of the at least one drive wheel in order to realize an active movement of the seat unit.

It is additionally proposed that the movement conversion unit comprises at least one rocker element which forms at least one cam mechanism element of the movement conversion unit. In a preferred manner, the rocker element forms the cam mechanism element, which is fixable, in particular fixed, by way of one end on the seat unit, in particular on the seat part of the seat unit. The rocker element is preferably movable about the pivot axis of the cam mechanism element, in particular movably supported so as to oscillate about the pivot axis in dependence on a rotational movement of the at least one drive wheel and on an interaction between the friction-reducing element arranged on the cam mechanism element realized as a rocker and the movement guide path of the further cam mechanism element arranged on the at least one drive wheel. The oscillating movement of the cam mechanism element is preferably transmissible to the seat unit, in particular to the seat part, as a result of fixing the cam mechanism element on the seat unit, in particular on the seat part. By means of the design according to the invention, a rotational movement of the at least one drive wheel can be utilized in a structurally simple manner in order to realize an active movement of the seat unit. An oscillating movement of the seat unit can be produced in an advantageous manner.

In addition, it is proposed that the movement conversion unit comprises at least one cam mechanism element which comprises at least one movably supported tapping element. The movably supported tapping element is preferably realized as a movably supported rolling element, in particular as a roll, as a wheel, as a ball bearing or the like. The movably supported tapping element is preferably realized as a movably supported rolling element which is supported so as to be rotatable on the cam mechanism element realized as a rocker element. The tapping element is preferably arranged on the further side of the cam mechanism element which is remote from the side of the cam mechanism element with which the cam mechanism element is fixable, in particular fixed, on the seat unit, in particular on the seat part of the seat unit. In a preferred manner, the tapping element is supported so as to be rotatable on the cam mechanism element by means of the friction-reducing element realized as a rolling bearing. The tapping element preferably realizes the contact surface of the cam mechanism element. It is also conceivable for the tapping element and the friction-reducing element to be realized in one piece at least in part. By means of the design according to the invention, it is advantageously possible to realize a sensing of the movement guide path of the further cam mechanism element that is gentle on the component. A rotational movement of the at least one drive wheel can be utilized in a structurally simple manner in order to realize an active movement of the seat unit. An oscillating movement of the seat unit can be produced in an advantageous manner.

The further cam mechanism element is preferably arrangeable, in particular fixable, on the at least one drive wheel together with a fixing unit which fixes a hand rim of the at least one drive wheel. The further cam mechanism element realized as a cam disc is preferably arrangeable on a side of the at least one drive wheel facing the framework or the frame of the wheelchair. By means of the design according to the invention, a compact arrangement of the further cam mechanism element on the at least one drive wheel is advantageously made possible. It is advantageously possible to utilize components that are already present and/or an already existing installation space sensibly for an arrangement of the further cam mechanism element. A convenient ability to retrofit a wheelchair, in particular with low expenditure, is advantageously possible with the wheelchair device according to the invention. A rotational movement of the at least one drive wheel can be utilized in a structurally simple manner in order to realize an active movement of the seat unit.

In addition, it is proposed that the movement conversion unit comprises at least one spring element which is provided for the purpose of loading at least one cam mechanism element of the movement conversion unit with a spring force. The spring element is preferably provided for the purpose of loading a cam mechanism element realized as a rocker element with a spring force. In a preferred manner, the spring element is provided for the purpose of loading the cam mechanism element with a spring force which acts in the direction of the further cam mechanism element. A "spring element" is to be understood, in particular, as a macroscopic element which comprises at least an extent which is resiliently modifiable in a normal operating state by at least 10%, in particular by at least 20%, preferably by at least 30% and particularly advantageously by at least 50%, and which generates, in particular, a counter force which is dependent on a modification in the extent, is preferably proportional to the modification and counteracts the modification. An "extent" of an element is to be understood, in particular, as a maximum distance between two points of a perpendicular projection of the element onto a plane. A "macroscopic element" is to be understood, in particular, as an element with an extent of at least 1 mm, in particular of at least 5 mm and preferably of at least 10 mm. The spring element is preferably realized as a helical compression spring. However, it is also conceivable for the spring element to comprise another design which appears sensible to the expert, such as, for example, a design as a screw tension spring, as an evolute spring, as a cup spring, as a leg spring or the like. By means of the design according to the invention, it is advantageously possible for the tapping element arranged on the cam mechanism element to abut reliably against the further cam mechanism element. Secure abutment of the tapping element arranged on the cam mechanism element against the movement guide path can advantageously be made possible.

In addition, it is proposed that the wheelchair device includes at least one activation unit which is provided for the purpose of activating or deactivating an action of the movement conversion unit on the seat unit, in particular the seat part and/or the backrest part, in particular as a result of manual activation by an operator. The activation unit is preferably realized as a mechanical activation unit which is manually activatable by an operator. At least one activation element, such as, for example, an activation lever or the like, is preferably manually activatable, in particular movable, by an operator. The activation element is preferably provided for the purpose of releasing or blocking a transmission of movement of the cam mechanism element to the seat unit, in particular the seat part and/or the backrest part, as a result of actuation by an operator, in particular in order to activate or deactivate an action of the movement conversion unit on the seat unit, in particular the seat part and/or the backrest part. The activation element can be provided for the purpose of releasing or blocking a possibility of movement of the cam mechanism element. As an alternative to this or in addition to it, the activation element can be provided for the purpose of releasing or blocking a possibility of movement of the seat unit, in particular of the seat part and/or of the backrest part. The activation element can be provided for the purpose of actively moving the cam mechanism element, in particular along and/or about an activation axis which, in particular, is different from a movement axis, in particular a pivot axis, of the cam mechanism element along and/or about which the cam mechanism element is movably supported for acting on the seat unit, in particular on the seat part and/or the backrest part. However, it is also conceivable for the activation unit to be realized at least in part in an electronic manner and to comprise at least one electronic component, such as, for example, an electronic actuator or the like. It is also conceivable for the activation unit to comprise a communication unit which is provided for the purpose of exchanging data, in particularly wirelessly, with an external unit, such as, for example, a smartphone, a tablet, a PC or the like, in particular by means of an application installed on the external unit, by means of which the electronic activation unit is actuatable. Further designs of the activation unit which appear sensible to an expert are also conceivable. Activation or deactivation of an active movement of the seat unit, in particular of the seat part and/or the backrest part, can be advantageously achieved by means of the design according to the invention. Greater operator comfort can advantageously be made possible as individually shutting down or switching on a function of the wheelchair device can be made possible.

A wheelchair, in particular a manually operable wheelchair, having at least one wheelchair device according to the invention is also proposed. The wheelchair preferably includes at least two rotationally movably supported drive wheels, at least one drive unit which comprises at least one movably supported lever element, in particular at least two movably supported lever elements which is/are provided for manually driving the drive wheels. The wheelchair preferably includes at least one brake unit for acting on the drive wheels and at least one actuating unit which comprises at least one movably supported steering operation element, which is arranged, in particular, on the lever element and is provided for the purpose of triggering the brake unit in such a manner that the drive wheels can be braked independently of one another, in particular for realizing a steering function. The at least one lever element is preferably provided for the purpose of driving the drive wheels by acting together with at least one transmission unit of the drive unit. The transmission unit and the at least one lever element act together in a preferred manner such that a pivoting movement, in particular going back and forth, of the at least one lever element is convertible by means of the transmission unit into a rotational movement of the drive wheels. In an especially preferred manner, the wheelchair includes the at least one drive wheel, on which is arranged at least the movement conversion unit of the wheelchair device, the movement conversion unit being realized separately to the transmission unit for driving the at least one drive wheel in a rotating manner. The drive unit preferably includes at least two movably supported, in particular pivotably supported, lever elements. In a preferred manner, the at least two lever elements are provided for the purpose of driving the drive wheels by acting together with the transmission unit. A movement of a single lever element of the at least two lever elements is preferably sufficient for moving the drive wheels via the transmission unit. However, it is also conceivable, as an alternative to this or in addition to it, for the transmission unit to be realized in such a manner that an, in particular, alternating movement and/or a movement in the opposite direction of the at least two lever elements can be utilized for a synchronized movement of the drive wheels. The transmission unit preferably includes at least one freewheel element which is provided for the purpose of uncoupling the at least one lever element or the at least two lever elements from a movement of the drive wheels, in particular in order to return the at least one lever element or the at least two lever elements into an initial position. One of the at least two lever elements is preferably arranged in each case on different sides of the wheelchair, in particular of a seat part or of the framework of the wheelchair. In a preferred manner, the at least two lever elements are movably coupled together, in particular coupled together so as to move in opposite directions, preferably by means of the transmission unit of the drive unit. When at least one of the lever elements moves in a direction, at least one further of the lever elements is movable in an opposite direction. The manually operable wheelchair is preferably realized so as to be operable by muscle power. However, it is also conceivable for the wheelchair to be realized uncoupled from the at least one movably supported lever element and to be drivable simply by means of operator force acting on the hand rim arranged on the at least one drive wheel or for the wheelchair to comprise an electrical drive unit for driving the drive wheels. A structurally simple design of the wheelchair device to drive the seat unit in an active manner can be realized advantageously by means of the design according to the invention. A rotational movement of the at least one drive wheel can be utilized advantageously in a structurally simple manner in order to realize an active movement of the seat unit.

The wheelchair device according to the invention and/or the wheelchair according to the invention is/are not to be restricted in this connection to the above-described application and embodiment. In particular, for fulfilling a method of operation described herein, the wheelchair device according to the invention and/or the wheelchair according to the invention can comprise a number which deviates from a number of individual elements, components and units named herein. In addition, in the case of the value ranges specified in this disclosure, values also lying within the named limits are to apply as disclosed and as arbitrarily usable.

DRAWINGS

Further advantages are produced from the following description of the drawings. An exemplary embodiment of the invention is shown in the drawings. The drawings, the description and the claims include numerous features in combination. The expert will also look at the features expediently in an individual manner and combine them to form sensible further combinations.

Figure 2:
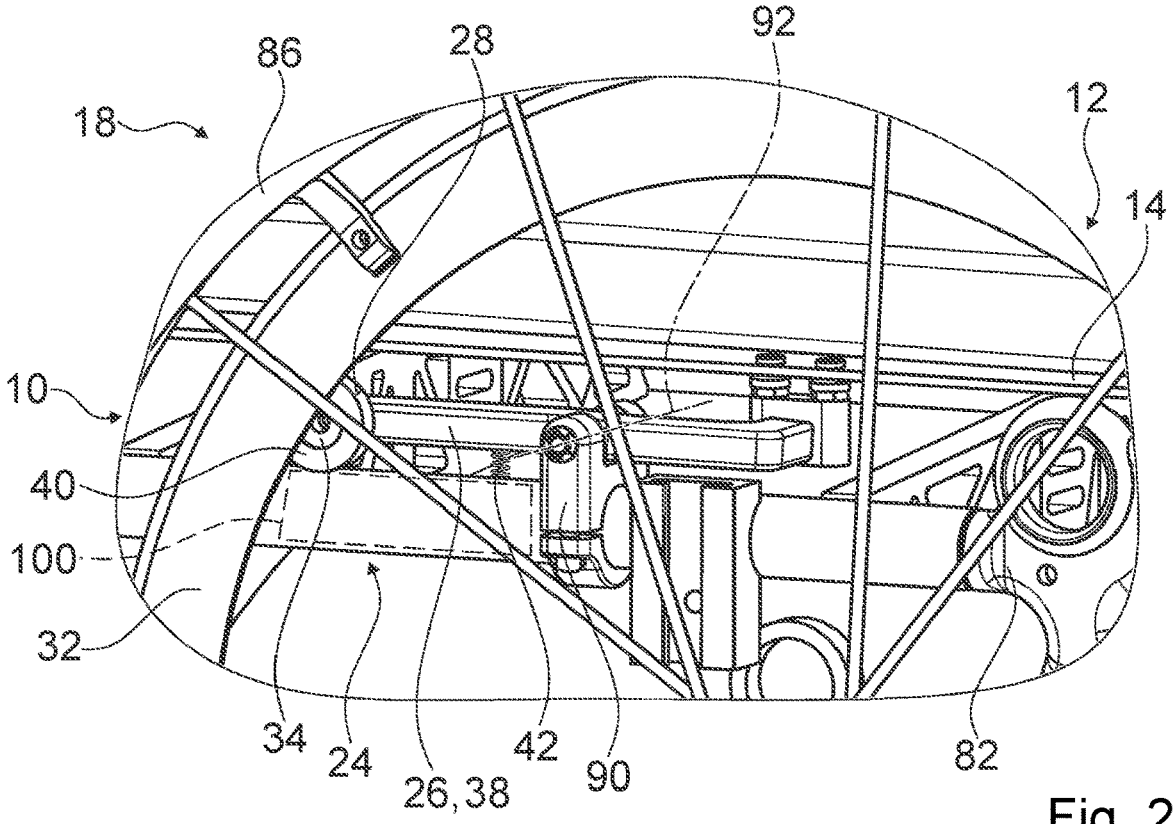
Figure 3:
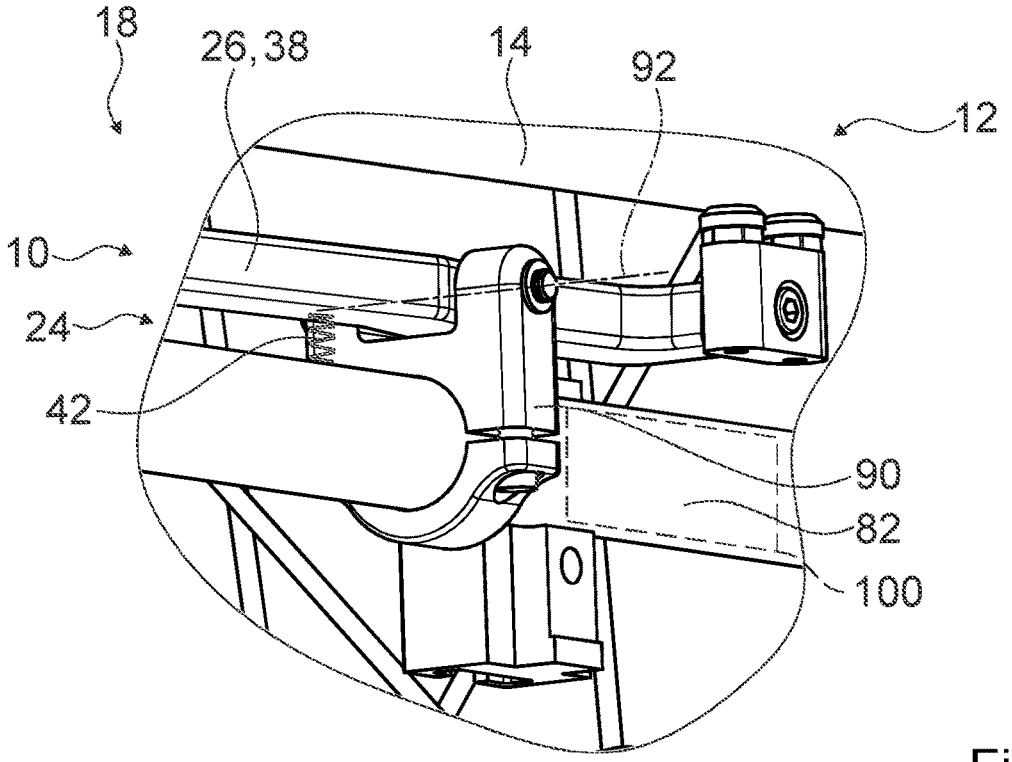
Figure 4:
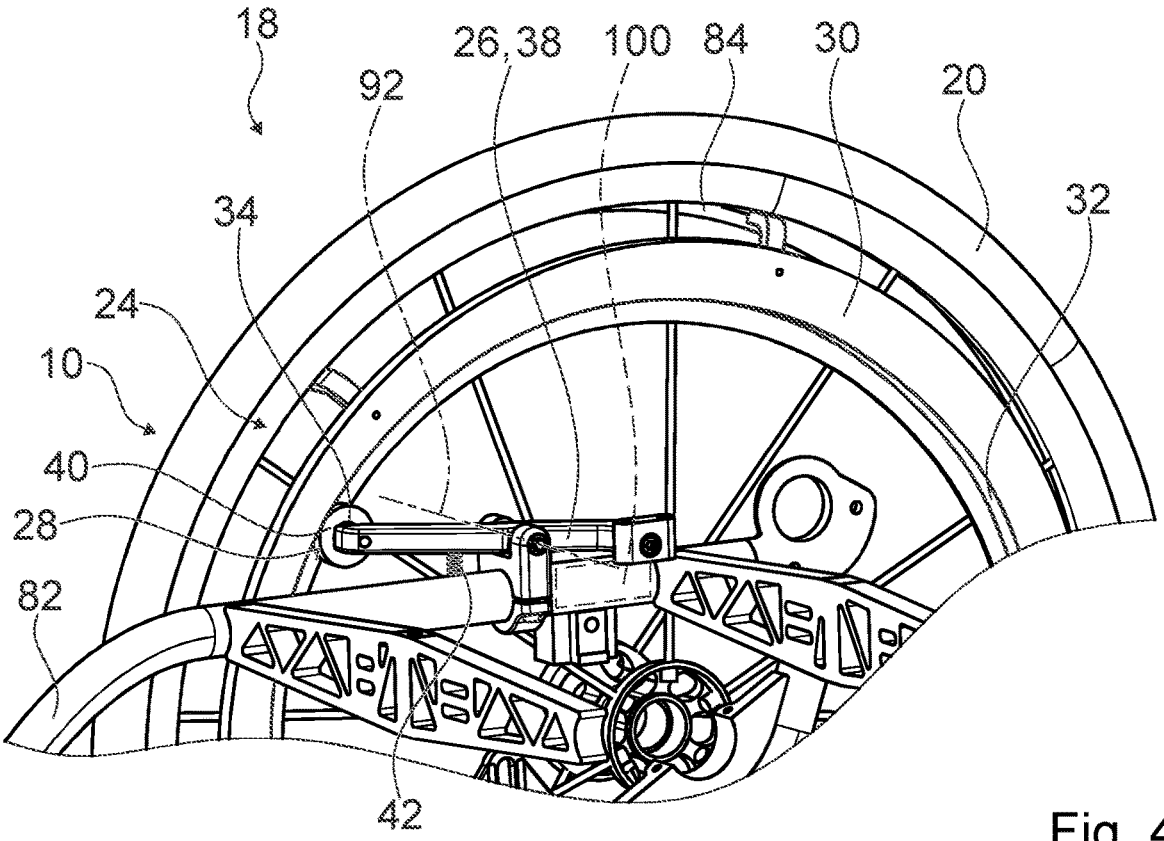
Figure 5:
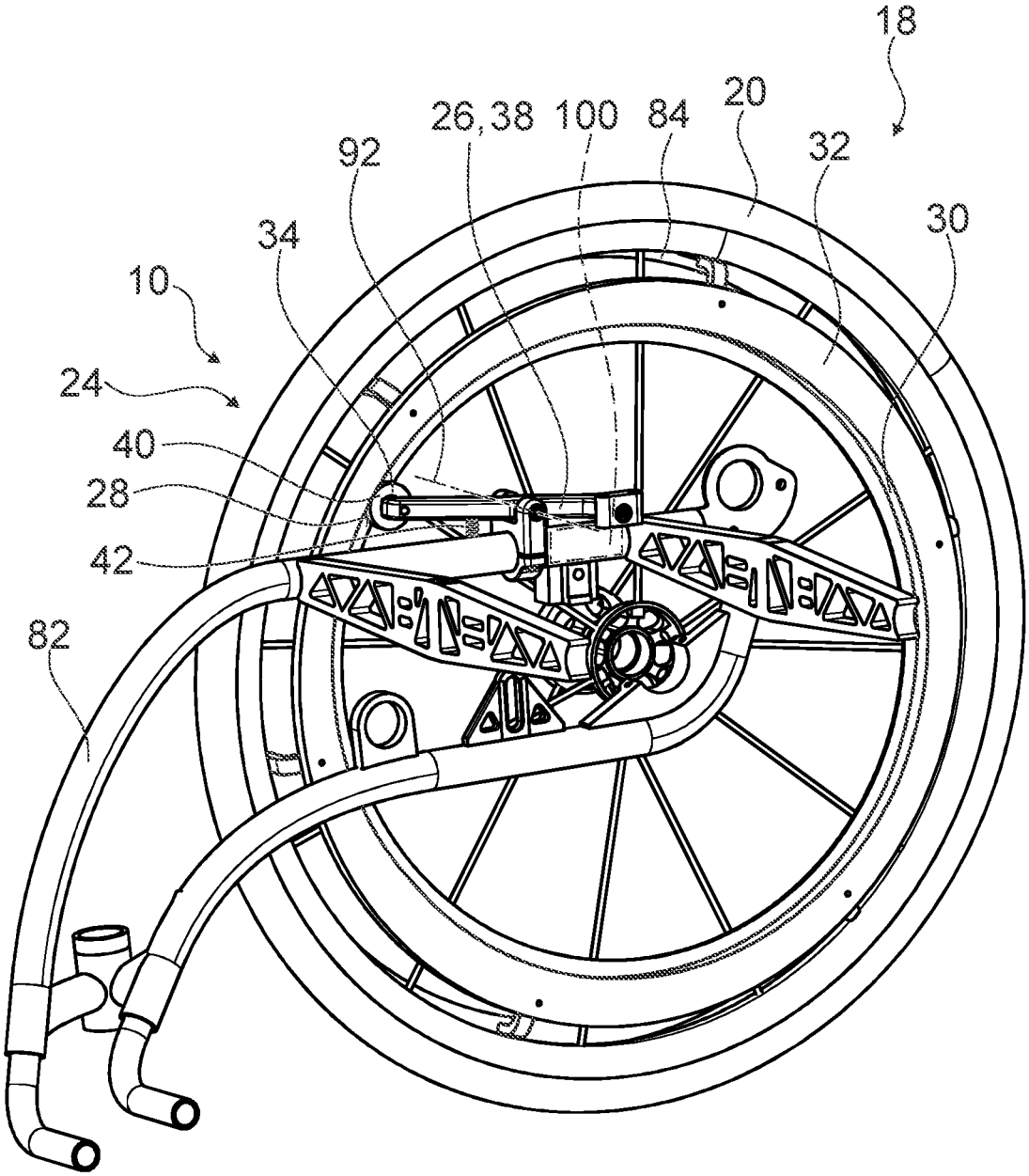

The drawings are as follows:

FIG. 1 shows a schematic representation of a front view of a wheelchair according to the invention having a wheelchair device according to the invention, supporting and/or steering wheels of the wheelchair according to the invention not being shown, FIG. 2 shows a schematic representation of a view of a detail of a movement conversion unit of the wheelchair device according to the invention, FIG. 3 shows a schematic representation of a view of a detail of the movement conversion unit arranged at least in part on a seat unit of the wheelchair according to the invention, FIG. 4 shows a schematic representation of a view of a detail of the movement conversion unit on the wheelchair according to the invention, the seat unit having been removed and FIG. 5 shows a schematic representation of a view of a detail of the movement conversion unit arranged at least in part on a framework or on a frame of the wheelchair according to the invention.

DESCRIPTION OF THE EXEMPLARY EMBODIMENT

FIG. 1 shows a wheelchair 18 with at least one wheelchair device 10 for actively moving a seat unit 12 of the wheelchair 18, in particular a seat part 14 and/or a backrest part 16 of the seat unit 12. The wheelchair 18 is preferably realized as a manually operable wheelchair. However, it is also conceivable for the wheelchair 18 to be realized as a motor-driven wheelchair. The wheelchair 18 is preferably realized in such a manner that an operator is able to drive the wheelchair 18 by way of the effect of muscle power. The wheelchair 18 includes at least two rotationally movably supported drive wheels 20, 22, at least one drive unit 46 which comprises at least one movably supported lever element 48, 50, which is provided at least for manually driving the drive wheels 20, 22, in particular as a result of the influence of the muscle power of the operator. In a preferred manner, the drive unit 46 includes at least two movably supported lever elements 48, 50.

In addition, the wheelchair 18 includes at least one brake unit 52 for acting on the drive wheels 20, 22 and at least one actuating unit 54 which comprises at least one movably supported steering operation element 56, 58 which is arranged, in particular, on the lever element 48, 50 and is provided for the purpose of triggering the brake unit 52 in such a manner that the drive wheels 20, 22 can be braked independently of one another, in particular for realizing a steering function. The actuating unit 54 of the wheelchair 18 includes at least one brake actuation element 60, 62, which is arranged, in particular, on the lever element 48, 50, for actuating the brake unit 52, the drive wheels 20, 22 being able to be braked together by means of the brake unit 52 in dependence on actuation of the brake actuation element 60, 62, in particular for reducing the speed of the drive wheels 20, 22 to a standstill.

The steering operation element 56, 58 is supported on the lever element 48, 50 so as to be rotatable and/or pivotable. A movement axis 64, 66 of the at least one lever element 48, 50 extends transversely, in particular at least substantially perpendicularly, to a main extension axis of the at least one lever element 48, 50. The at least one brake actuation element 60, 62 is arranged on the at least one steering operation element 56, 58 and is supported together with the at least one steering operation element 56, 58 so as to be rotatable and/or pivotable, in particular about the movement axis 64, 66 of the at least one steering operation element 56, 58. The at least one brake actuation element 60, 62 is preferably realized as a brake lever which is pivotably supported. A pivot axis 68, 70 preferably extends transversely, in particular at least substantially perpendicularly, to the movement axis 64, 66 of the at least one steering operation element 56, 58. In particular, the pivot axis 68, 70 forms a further movement axis of the at least one brake actuation element 60, 62, in particular with reference to the movement axis 64, 66 of the at least one steering operation element 56, 58, preferably for an actuation of the brake unit 52 as a result of a movement of the at least one brake actuation element 60, 62.

The actuation unit 54 comprises at least one coupling unit 72, by means of which brake elements 74, 76 of the brake unit 52 assigned to the drive wheels 20, 22 are operatively connected to the brake actuation element 60, 62 and/or to the steering operation element 56, 58. The brake elements 74, 76 are preferably realized as movably supported brake blocks. The brake elements 74, 76 are preferably provided for the purpose of acting in each case on a brake disc 78, 80 of the brake unit 52. However, it is also conceivable for the brake elements 74, 76 to comprise a different design which appears sensible to an expert, such as, for example, a design as a brake pad, as brake blocks, as a brake shoe or the like which are provided for the purpose of acting directly on the drive wheels 20, 22 in a manner already known to an expert. A brake disc 78, 80 is preferably assigned to each of the drive wheels 20, 22. One of the brake elements 74, 76 is preferably assigned to each of the drive wheels 20, 22. The brake discs 78, 80 are assigned to the drive wheels 20, 22 in a manner known to an expert.

The wheelchair 18 comprises at least one framework 82 which shows at least one seat unit 12, the two drive wheels 20, 22 and two support and/or steering wheels (not shown in any detail here, FIG. 5 showing at least one bearing point of one of the support wheels and/or steering wheels). The seat unit 12 includes the at least one seat part 14 and the at least one backrest part 16. The support wheels and/or steering wheels are each supported on the framework 82, in a manner already known to an expert, so as to be rotatable about a vertical axis which is not marked separately here. The drive wheels 20, 22 each include a hand rim 84, 86 which comprises a design and/or arrangement already known to an expert on each of the drive wheels 20, 22. The hand rims 84, 86 arranged on the drive wheels 20, 22 are preferably provided for alternatively driving the drive wheels 20, 22 manually. The drive wheels 20, 22 are preferably rotatably supported on the framework 82 in bearing bushes, which are not shown in any detail, by means of a common wheel axle element 88 of the wheelchair 18. The seat unit 12 of the wheelchair 18 defines a seat direction of the wheelchair 18 in particular by an arrangement of the seat part 14 and of the backrest part 16 relative to one another and relative to the framework 82. The seat direction preferably coincides with a forwardly directed, straight direction of travel.

The drive unit 46 is arranged at least in part on the framework 82. The at least one lever element 48, 50 is preferably provided for the purpose of driving the drive wheels 20, 22 by acting together with at least one transmission unit 44 of the drive unit 46. The transmission unit 44 and the at least one lever element 48, 50 preferably act together such that a pivoting movement, in particular going back and forth, of the at least one lever element 48, 50 is convertible by means of the transmission unit 44 into a rotational movement of the drive wheels 20, 22. The at least two lever element 48, 50 are provided in a preferred manner for the purpose of driving the drive wheels 20, 22 by acting together with the transmission unit 44. The wheelchair 18 preferably includes the at least one drive wheel 20, 22, on which is arranged at least one movement conversion unit 24 of the wheelchair device 10 for actively moving the seat unit 12 of the wheelchair 18, the movement conversion unit 24 being realized separately to the transmission unit 44 which is provided for the purpose of driving the at least one drive wheel 20, 22 in a rotating manner as a result of the influence of operator force on at least one of the lever elements 48, 50.

The transmission unit 44 preferably includes at least one freewheel element (not shown in any detail here) which is provided for the purpose of uncoupling the at least one lever element 48, 50 or the at least two lever elements 48, 50 from a movement of the drive wheels 20, 22, in particular in order to return the at least one lever element 48, 50 or the at least two lever elements 48, 50 into an initial position. One of the at least two lever elements 48, 50 is preferably arranged in each case on different sides of the wheelchair 18, in particular of the seat part 14 or of the framework 82 of the wheelchair 18. In a preferred manner, the at least two lever elements 48, 50 are movably coupled together, in particular coupled together so as to move in opposite directions, preferably by means of the transmission unit 44 of the drive unit 46. When at least one of the lever elements 48, 50 moves in a direction, at least one further of the lever elements 48, 50 is movable in an opposite direction. The wheelchair 18 is preferably realized so as to be operable by muscle power. However, it is also conceivable, in an alternative design, for the wheelchair 18 to be realized uncoupled from the drive unit 46 and/or the transmission unit 44 and to be drivable purely by the action of the muscle power of an operator on the hand rims 84, 86.

The wheelchair device 10 for actively moving the seat unit 12, in particular the seat part 14 and/or the backrest part 16 of the seat unit 12, includes at least the movement conversion unit 24 which is arrangeable, in particular arranged, in part on at least one of the drive wheels 20, 22 of the wheelchair 18 and is provided for the purpose of converting a movement of the at least one drive wheel 20, 22 into a movement of the seat unit 12. The movement conversion unit 24 is preferably realized as a cam mechanism unit. The movement conversion unit 24 comprises at least one movably supported cam mechanism element 26 which is arrangeable, in particular arranged, on the seat unit 12 and which comprises at least one contact surface 28 which acts together with at least one movement guide path 30 of at least one further cam mechanism element 32 of the movement conversion unit 24 (cf. FIGS. 2 to 5). The movement conversion unit 24 comprises, at least for action on the seat part 14, at least the movably supported cam mechanism element 26 which is arrangeable on the seat part 14 and which comprises the contact surface 28 which acts together with at least the movement guide path 30 of at least the further cam mechanism element 32 of the movement conversion unit 24. In a preferred manner, the cam mechanism element 26 includes at least one seat contact surface, by means of which the cam mechanism element 26 can abut, in particular abuts, against the seat unit 12, in particular against the seat part 14. The seat contact surface is preferably provided for the purpose of abutting against a side of the seat part 14 remote from the seat surface of the seat part 14 on the seat part 14. The further cam mechanism element 32 is arranged in a preferred manner on at least one of the drive wheels 20, 22, in particular is fixed non-rotatably on one of the drive wheels 20, 22. In a preferred manner, at least one further cam mechanism element 32 is arranged on each of the drive wheels 20, 22. Each of the drive wheels 20, 22 preferably has assigned thereto at least one single cam mechanism element 26 which is provided for the purpose of acting together with the further, further cam mechanism element 32 arranged on the corresponding drive wheel 20, 22. However, it is also conceivable for just one of the drive wheels 20, 22 to have assigned thereto one single cam mechanism element 26 and one single further cam mechanism element 32.

The cam mechanism element 26 is realized in a preferred manner as a rocker element 38. The cam mechanism element 26 is preferably supported so as to be movable on the framework 82 by means of a support element 90 of the movement conversion unit 24. In a preferred manner, the cam mechanism element 26 is supported so as to be pivotable on the framework 82. The cam mechanism element 26 comprises a pivot axis 92 which extends at least substantially parallel to a rotational axis 94 of the at least one drive wheel 20, 22. However, it is also conceivable, in an alternative design of the movement conversion unit 24, for the cam mechanism element 26 to be supported so as to be translational on the framework 82 for actively moving the seat unit 12, for example a translation axis of the cam mechanism element 26 extending at least substantially perpendicularly to the rotational axis 94 of the at least one drive wheel 20, 22, in particular at least substantially parallel to a longitudinal axis of a framework element of the framework 82, which includes a guide path for guiding the cam mechanism element 26 in a linear manner.

The cam mechanism element 26 is fixed by way of a least one end on the seat unit 12, in particular on the seat part 14, in particular for moving the seat part 14 in dependence on a movement of the cam mechanism element 26. The cam mechanism element 26 is fixed on the seat part 14 in a preferred manner on a side of the seat part 14 remote from a seat surface 36 of the seat part 14. It is also conceivable for the cam mechanism element 26 to be provided uncoupled from a fixing on the seat part 14 for acting on the seat part 14, such as, for example, as a result of striking and/or abutting against the seat part 14.

The movement conversion unit 24 comprises at least the cam mechanism element 26 on which is arranged at least one friction-reducing element 34, in particular a rolling element, of the movement conversion unit 24 which is provided to act together with the movement guide path 30 of the movement conversion unit 24, in particular of at least the further cam mechanism element 32 of the movement conversion unit 24. The friction-reducing element 34 is preferably arranged on an end of the cam mechanism element 26 facing the further cam mechanism element 32, in particular the movement guide path 30. The friction-reducing element 34 is preferably realized as a rolling bearing, in particular as a ball bearing.

The movement conversion unit 24 comprises at least the cam mechanism element 26 which comprises at least one movably supported tapping element 40. The tapping element 40 is preferably supported so as to be rotatable on the cam mechanism element 26 by means of the friction-reducing element 34. The tapping element 40 is preferably realized as a rolling element, in particular as a roll, as a wheel, as a roller or the like, which is provided for the purpose of rolling along the movement guide path 30. The friction-reducing element 34 is preferably provided to act together, in particular indirectly, with the movement guide path 30 via the tapping element 40. However, it is also conceivable, in an alternative design, for the movement conversion unit 26 to be realized uncoupled from the tapping element 40 and for the friction-reducing element 34 to be provided to act together directly with the movement guide path 30, in particular for forming the contact surface 28 of the cam mechanism element 26 and abutting against the movement guide path 30. In the alternative design of the movement conversion unit 26, it is also conceivable for the friction-reducing element 34 to be realized alternatively as a sliding element which comprises a sliding surface which can be applied to the movement guide path 30, in particular abuts against the same.

The movement conversion unit 24 comprises at least the further cam mechanism element 32 which is realized as a cam disc and is arranged on the at least one drive wheel 20, 22. The further cam mechanism element 32 preferably comprises a circular ring-shaped design, an outside contour of the further cam mechanism element 32 comprising a design which deviates from an inside contour of the further cam mechanism element 32. The outside contour of the further cam mechanism element 32 preferably comprises a circular progression. The inside contour of the further cam mechanism element 32 preferably comprises a non-circular progression. The outside contour of the further cam mechanism element 32 is preferably formed by a circle line. The inside contour of the further cam mechanism element 32 is realized in a preferred manner deviating from a circle line. The further cam mechanism element 32 forms the movement guide path 30, with which the cam mechanism element 26, in particular the contact surface 28 of the cam mechanism element 26, acts together. The movement guide path 30 is preferably formed by the inside contour of the further cam mechanism element 32. The movement conversion unit 24 comprises at least the further cam mechanism element 32 which is arrangeable, in particular arranged, on the at least one drive wheel 20, 22 and comprises at least the movement guide path 30 which comprises a non-circular, in particular oval or elliptical, progression (cf. FIG. 5). The inside contour of the further cam mechanism element 32 is preferably arranged on a side of the further cam mechanism element 32 facing a hub of the at least one drive wheel 20, 22.

The movement conversion unit 24 comprises at least one spring element 42 which is provided for the purpose of loading at least the cam mechanism element 26 of the movement conversion unit 24 with a spring force. The spring element 42 is preferably provided for the purpose of loading the cam mechanism element 26 with a spring force in the direction of the further cam mechanism element 32. The spring element 42 is preferably realized as a helical compression spring. However, it is also conceivable for the spring element 42 to comprise a different design which appears sensible to an expert, such as, for example, a design as a leg spring, as an evolute spring, as a tensile spring or the like. The spring element 42 is preferably supported by way of at least one end on the framework 82. By way of a further end, the spring element 42 is supported in a preferred manner on the cam mechanism element 26. The cam mechanism element 26 can advantageously abut reliably against the movement guide path 30 for actively moving the seat unit 12.

In a preferred manner, the seat part 14 and/or the backrest part 16 are supported on the framework 82 by means of a seat suspension device, not shown here in any detail, in such a manner that the seat part 14 and/or the backrest part 16 can be moved sideways about a seat part center position and/or a backrest part center position. In a preferred manner, the seat part 14 is movably supported about a horizontal axis 96. The seat part 14 is preferably supported so as to be pivotable about the horizontal axis 96. The horizontal axis 96 preferably extends at least substantially parallel to a seat surface 36. As an alternative to this or in addition to it, the seat part 14 could be advantageously movably supported about a vertical axis 98 which extends at least substantially to the horizontal axis 96 and/or to the seat surface 36 so that the seat part 14 would be swinging, for example, oscillating in a horizontal plane. The backrest part 16 is preferably connectable, in particular connected, via a transmission unit, which is not shown in any detail, to the seat part 14 and/or to the movement conversion unit 24. The backrest part 16 is preferably connected to the seat part 14 and/or to the movement conversion unit 24 in such a manner by means of the transmission unit that the backrest part 16, when the seat part 14 is moved about the vertical axis 98, is correspondingly movable sideways in an oscillating manner from its backrest part center position.

For actively moving the seat unit 12, in particular the seat part 14 and/or the backrest part 16 of the seat unit 12, by means of the movement conversion unit 24, a movement of the at least one drive wheel 20, 22 is preferably converted into a movement of the seat unit 12. As a result of a non-rotatable arrangement of the further cam mechanism element 32 on the at least one drive wheel 20, 22, the further cam mechanism element 32 together with the at least one drive wheel 20, 22 is driven in a rotating manner, in particular as a result of the action of the muscle power of an operator via the hand rims 84, 86 or via the lever elements 48, 50. The cam mechanism element 26 acts together with the movement guide path 30 of the further cam mechanism element 32 in such a manner that the cam mechanism element 26 is pivotable, in particular is pivoted, as a result of a rotation of the further cam mechanism element 32 about the pivot axis 92 of the cam mechanism element 26, in particular as a result of a non-circular, in particular oval or elliptical, design of the movement guide path 30. The oscillating pivoting movement of the cam mechanism element 26 produced by the interaction between the cam mechanism element 26 and the movement guide path 30 is transmissible to the seat unit 12, in particular to the seat part 14. The seat unit 12 is actively movable in a particularly structurally simple manner by means of the movement conversion unit 24 in dependence on a rotation of the at least one drive wheel 20, 22.

The wheelchair device 10 includes at least one activation unit 100 which is provided for the purpose of activating or deactivating an action of the movement conversion unit 24 on the seat unit 12, in particular the seat part 14 and/or the backrest part 16, in particular as a result of manual activation by an operator (cf. FIG. 2). The activation unit 100 is preferably realized as a mechanical activation unit which is activatable manually by an operator. At least one activation element (not shown in any detail here) such as, for example, an activation lever or the like, is preferably actuatable, in particular movable, by an operator. The activation element is preferably provided, as a result of an actuation by an operator, for the purpose of releasing or blocking a transmission of movement of the cam mechanism element 26 to the seat unit 12, in particular the seat part 14 and/or the backrest part 16, in particular in order to activate or deactivate an action of the movement conversion unit 24 on the seat unit 12, in particular the seat part 14 and/or the backrest part 16. The activation element can be provided for the purpose of releasing or blocking a possibility of movement of the cam mechanism element 26. As an alternative to this or in addition to it, the activation element can be provided for the purpose of releasing or blocking a possibility of movement of the seat unit 12, in particular of the seat part 14 and/or of the backrest part 16. The activation element can be provided for the purpose of actively moving the cam mechanism element 26, in particular along and/or about an activation axis, which is different, in particular, from a movement axis, in particular the pivot axis 92, of the cam mechanism element 26 along and/or about which the cam mechanism element 26 is movably supported for acting on the seat unit 12, in particular on the seat part 14 and/or the backrest part 16. As an alternative to this or in addition to it, the activation element can be provided for the purpose of actively moving the further cam mechanism element 32, in particular of moving it away from the cam mechanism element 26, such as, for example, as a result of moving the further cam mechanism element 32 along an at least substantially parallel to the rotational axis 94 or the like. However, it is also conceivable for the activation unit 100 to be realized at least in part in an electronic manner and to comprise at least one electronic component, such as, for example, an electronic actuator or the like which is provided for the purpose of activating or deactivating an action of the movement conversion unit 24 on the seat unit 12, in particular on the seat part 14 and/or the backrest part element 16. It is also conceivable for the activation unit 100 to comprise a communication unit which is provided for the purpose of exchanging data, in particularly wirelessly, with an external unit (not shown in any detail here), such as, for example, a smartphone, a tablet, a PC or the like, in particular by means of an application installed on the external unit, by means of which the electronic activation unit is actuatable. Further designs of the activation unit 100 which appear sensible to an expert are also conceivable. The activation unit 100 is preferably provided for the purpose of acting synchronously on the cam mechanism elements 26 assigned to the individual drive wheels 20, 22 and/or the further cam mechanism elements 32. However, it is also conceivable for an own activation element, which is actuatable independently of the respectively other activation elements, to be assigned to each of the cam mechanism elements 26 assigned to the individual drive wheels 20, 22 and/or to the further cam mechanism elements 32.

The invention claimed is:

1. A wheelchair device for actively moving a seat part of a seat unit of a wheelchair, the wheelchair device having:

at least one movement conversion unit which arranged at least in part on at least one drive wheel of the wheelchair and which is provided for the purpose of converting a movement of the at least one drive wheel into a movement of the seat unit, wherein the movement conversion unit is realized as a cam mechanism unit, wherein, at least for acting on the seat part, the movement conversion unit comprises at least one movably supported cam mechanism element which is arrangeable on the seat part and comprises at least one contact surface which acts together with at least one movement guide path of at least one further cam mechanism element of the movement conversion unit, wherein the movement conversion unit comprises the at least one further cam mechanism element which is realized as a cam disc and is arranged on the at least one drive wheel, and wherein the at least one movement guide path of the at least one further cam mechanism element is arranged on an inside surface of the at least one further cam mechanism element facing a hub of the at least one drive wheel.

2. The wheelchair device as claimed in claim 1, wherein the movement conversion unit comprises at least the cam mechanism element on which is arranged at least one rolling element acting as a friction-reducing element, of the movement conversion unit which is provided for acting together with the at least one movement guide path of the at least one further cam mechanism element of the movement conversion unit.

3. The wheelchair device as claimed in claim 1, wherein the movement conversion unit comprises the at least one further cam mechanism element which is arrangeable on the at least one drive wheel and comprises at least the movement guide path which comprises an oval or elliptical, progression.

4. The wheelchair device as claimed in claim 1, wherein the movement conversion unit comprises at least one rocker element which forms at least one cam mechanism element of the movement conversion unit.

5. The wheelchair device as claimed in claim 1, wherein the movement conversion unit comprises the at least one cam mechanism element which comprises at least one movably supported tapping element.

6. The wheelchair device as claimed in claim 1, wherein the movement conversion unit comprises at least one spring element which is provided for the purpose of loading the at least one cam mechanism element of the movement conversion unit with a spring force.

7. The wheelchair device as claimed in claim 1, further comprising at least one activation unit which is provided for the purpose of activating or deactivating an impact of the movement conversion unit on the seat part of the seat unit as a result of manual activation by an operator.

8. A manually operable wheelchair, having at least one wheelchair device as recited in claim 1.

9. The wheelchair as claimed in claim 8, further comprising the at least one drive wheel, on which at least the movement conversion unit of the wheelchair device is arranged, wherein the movement conversion unit is realized separately to a transmission unit for driving the at least one drive wheel in a rotating manner.

* * * * *